United States Patent [19]

Crowther et al.

[11] 4,194,452

[45] Mar. 25, 1980

[54] CONVERTIBLE TABLE

[76] Inventors: William H. Crowther, 4605 State Route 2, Everett, Wash. 98205; Gregory A. Carpenter, 5325 - 89th St. NE., Marysville,, Wash. 98270

[21] Appl. No.: 914,442

[22] Filed: Jun. 12, 1978

[51] Int. Cl.[2] ..... A47B 11/00; A47B 81/00

[52] U.S. Cl. ..... 108/138; 108/99; 108/161; 248/166; 312/276

[58] Field of Search ..... 108/6, 99, 138, 77, 108/11, 161, 17; 312/230, 231, 110, 195, 276; 297/310; 248/166, 150

[56] References Cited

U.S. PATENT DOCUMENTS

| | | | |
|---|---|---|---|
| 210,031 | 11/1878 | Hawthorn | 108/138 |
| 1,956,546 | 4/1934 | Froelich | 108/136 X |
| 2,170,098 | 8/1939 | Stephenson | 108/136 |
| 2,766,088 | 10/1956 | Jackson et al. | 108/99 |
| 2,845,114 | 7/1958 | Edwards | 108/138 X |
| 3,195,482 | 7/1965 | Whitfield | 108/138 |
| 3,288,090 | 11/1966 | King | 108/138 |
| 3,322,480 | 5/1967 | Barnstead et al. | 312/276 |
| 3,347,184 | 10/1967 | Kiraly | 108/136 |
| 3,738,727 | 6/1973 | Race et al. | 312/276 |
| 3,926,472 | 12/1975 | Evans | 297/310 X |

FOREIGN PATENT DOCUMENTS

| | | | |
|---|---|---|---|
| 1245099 | 9/1971 | United Kingdom | 108/77 |

*Primary Examiner*—James T. McCall

*Attorney, Agent, or Firm*—Robert W. Beach; Ward Brown

[57] ABSTRACT

Parallel links pivotally connect each end of a tabletop to a table base so that the top can be swung in level attitude elevationally and laterally relative to the base. A tie rod synchronizes the movement of links at opposite ends of the top to maintain such links in alignment for smooth swinging of the top. When the top is swung upward and outward from a position centrally of the table base, mechanism responsive to such swinging of the top automatically projects a stabilizing foot outward beyond the side of the base toward which the top moves, and such mechanism retracts such foot into the base when the top is swung downward and inward.

15 Claims, 20 Drawing Figures

Fig. 12
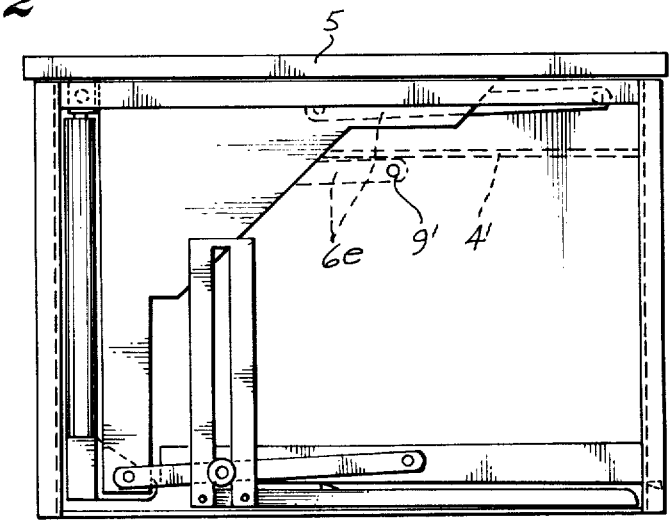
Fig. 20
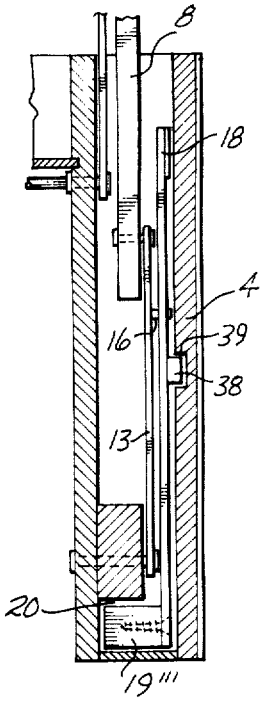
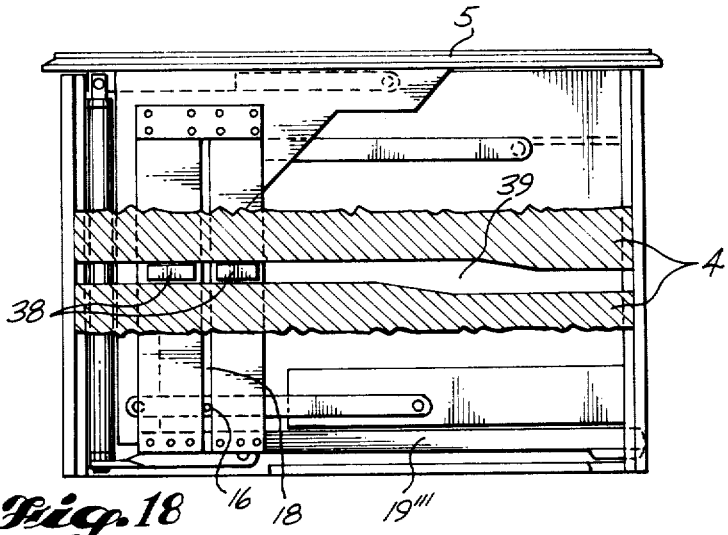
Fig. 18
Fig. 19
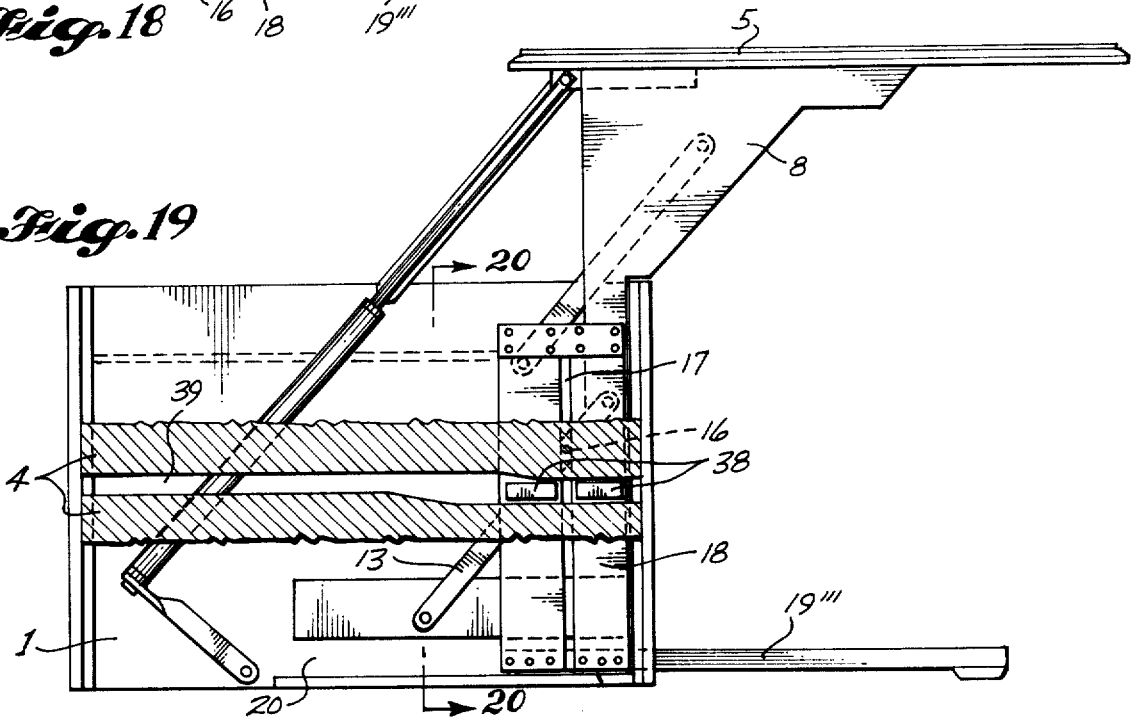

CONVERTIBLE TABLE

BACKGROUND OF THE INVENTION

1. Field of the Invention

The present invention relates to a convertible table having a tabletop displaceable relative to a table base between a lowered position and a laterally offset raised position. Preferably a long low rectangular table has two side-by-side tops, arranged in tandem relationship lengthwise of the table, that can be moved independently between lowered central positions and raised positions laterally offset from center toward the same side of the table base. With the tops in their lowered positions, the table can be used as a conventional coffee table, for example to be placed adjacent to a sofa. The table is "convertible" in that its tops can be shifted to raised positions in which the tops are above the lap height of a person sitting on the sofa and offset laterally relative to the base toward the sofa and over such person's legs and feet. The raised tops provide convenient supporting surfaces for writing or reading materials, or for eating utensils.

2. Prior Art

Convertible tables having tabletops displaceable elevationally and laterally relative to table bases are shown in the following U.S. Pat. Nos.:

Jackson et al., 2,766,088

Whitfield, 3,195,482

The problem with the convertible tables of the above patents is that when a top is offset laterally relative to a base the table is easily upset. The Whitfield patent provides no mechanism for stabilizing a table having a top offset laterally from the base. Although the Jackson et al. patent provides a counterweight carried by the table base, such weight makes it more difficult to move the table from one location to another, and the table may still be tilted or tipped over by the application of downward force to a laterally offset top.

No convertible table is known in which stabilizers are projected outward from a table base automatically by displacing a tabletop into a position offset laterally from the base. In addition, no convertible table is known in which a displaceable top is pivotally connected to a base by parallel links at each end of the top and mechanism synchronizes the swinging of the links.

SUMMARY OF THE INVENTION

The principal object of the present invention is to provide a convertible table including a tabletop displaceable elevationally and laterally relative to a table base in which tipping of the table is deterred when the top is offset laterally from the base.

It is also an object to provide a convertible table including a tabletop which may be swung smoothly elevationally and laterally relative to a table base without jamming.

The foregoing objects can be accomplished by providing a convertible table including a tabletop elevationally and laterally displaceable relative to a table base and a stabilizer projectable outward from the base automatically in response to lateral displacement of the top. In the preferred embodiment of the invention, the top is pivotally connected to the base by parallel links at each end of the top, a tie rod connects links at opposite ends of the top to synchronize their movement and projection of the stabilizer is responsive to the swinging of a link which occurs as the tabletop is moved.

BRIEF DESCRIPTION OF THE DRAWINGS

FIG. 12 is a corresponding end elevation with parts in different positions.

FIG. 18 (on the drawing sheet with FIG. 12) is an end elevation of still another alternative embodiment of a convertible table in accordance with the present invention, parts being broken away, and FIG. 19 (on the drawing sheet with FIG. 12) is a corresponding end elevation with parts in different positions.

FIG. 20 (on the drawing sheet with FIG. 12) is a section taken on line 20—20 of FIG. 19 with parts broken away.

DETAILED DESCRIPTION

Figure 1:
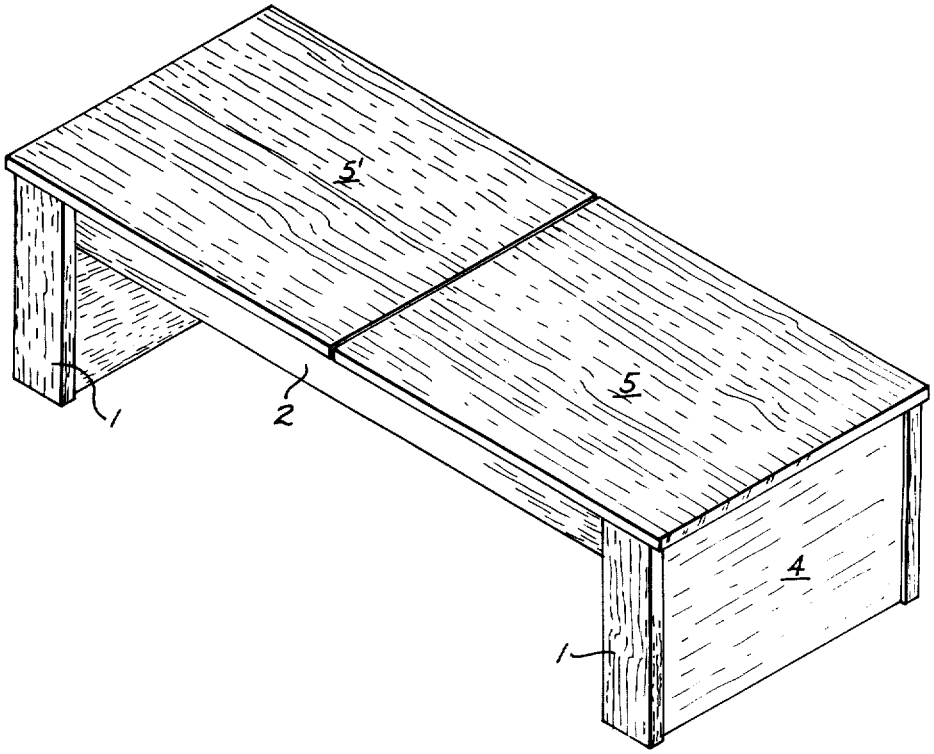
FIG. 1 is a top perspective of a convertible table in accordance with the present invention.
Figure 2:
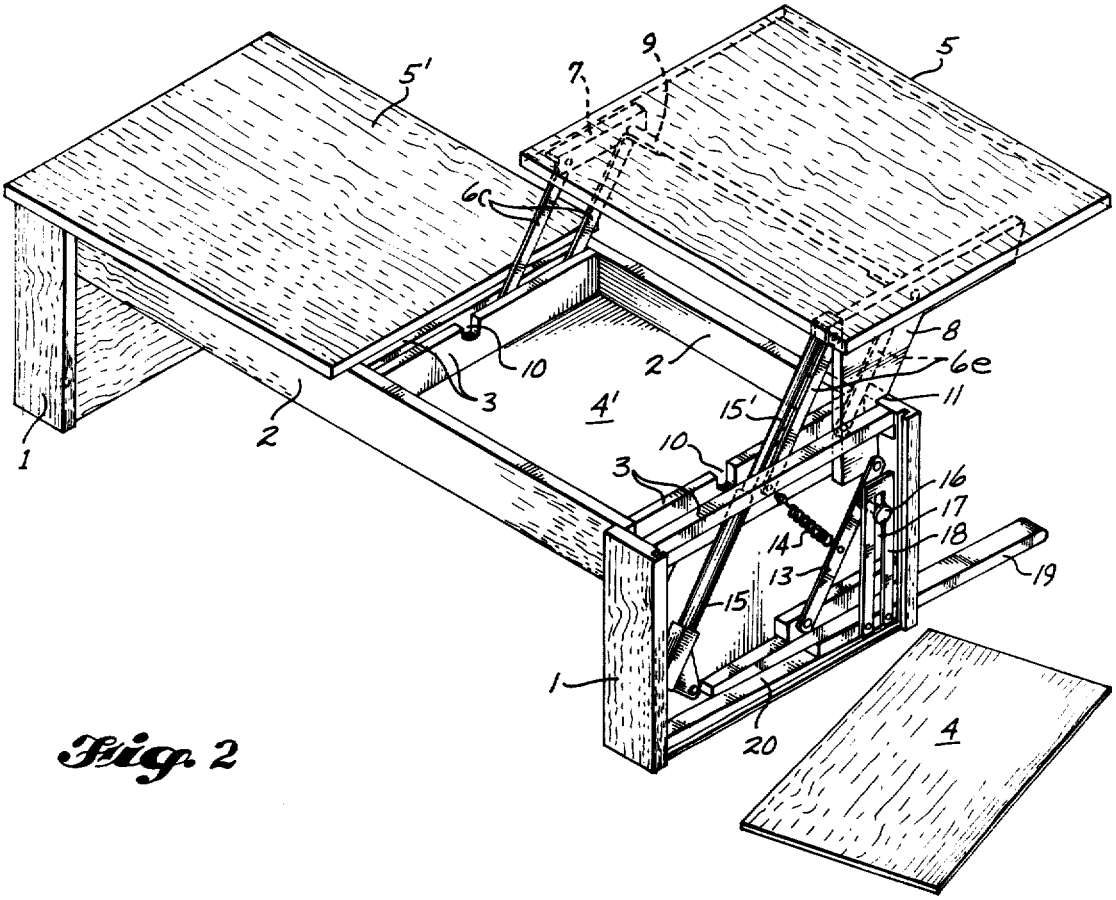
FIGS. 2 and 3 are top perspectives corresponding to FIG. 1 with parts in different positions.
Figure 3:
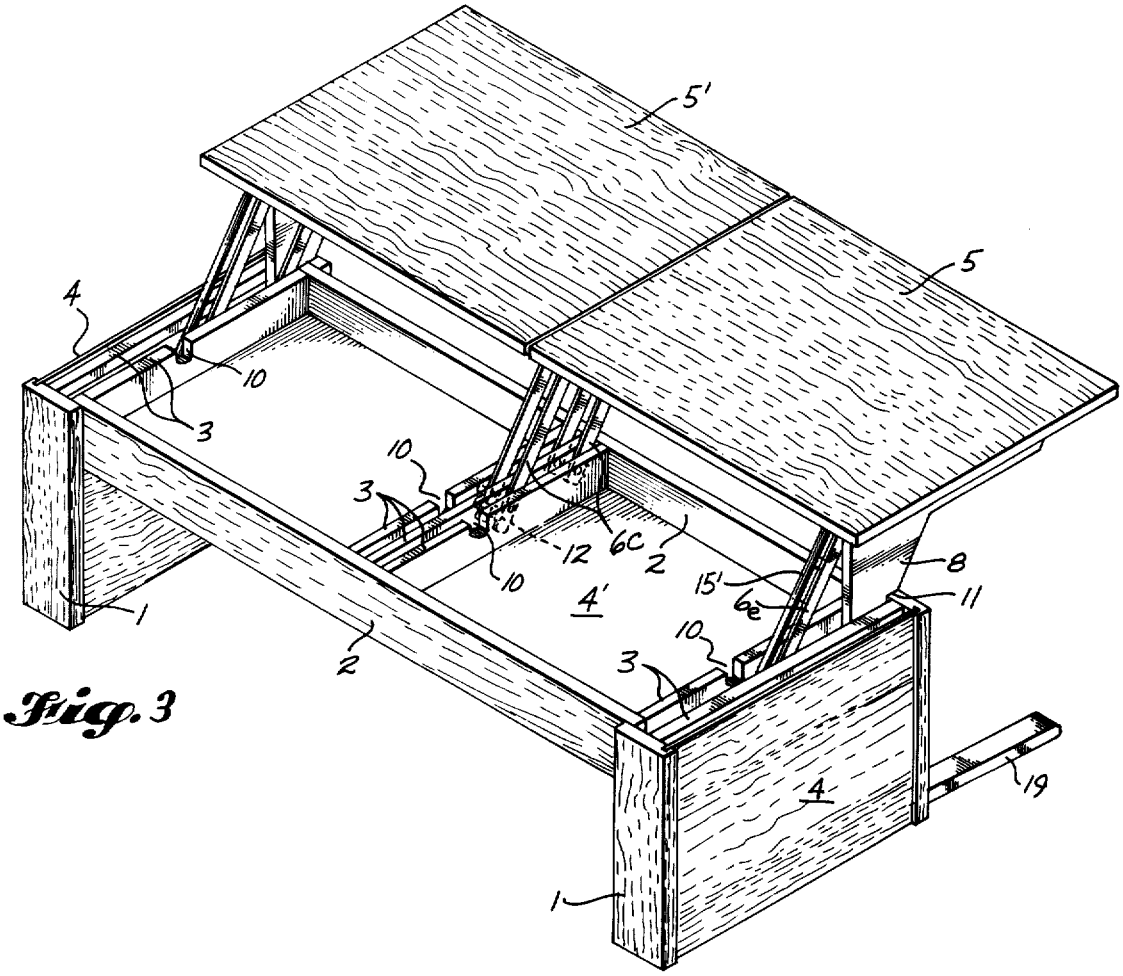

In the preferred embodiment of the invention, an elongated rectangular table base supports side-by-side tabletops 5 and 5' in tandem relationship. The tops are swingably connected to the base for movement between "normal" lowered positions, shown in FIG. 1, in which the tops are generally aligned with and supported centrally by the base, and raised "offset" positions, shown in FIG. 3, in which the tops are displaced elevationally and laterally relative to one side of the base. As seen in FIG. 2, tops 5 and 5' are independently displaceable.

The table base includes opposite ends or legs 1, front and rear longitudinal rails 2 spanning between the legs and horizontal cross rails 3 extending perpendicular to and connecting the centers and opposite ends of the longitudinal rails. Each table leg supports the end cross rails, is hollow and includes a removable outer end panel 4. Bottom panels 4' close the table base between the longitudinal rails 2 and between the cross rails 3 so that the spaces beneath the tabletops in lowered positions can be used for storage. The preferred convertible table is symmetrical about a vertical plane between the two tops extending transversely of the table length and, consequently, only the portion of the table carrying top 5 is described in detail herein. Nevertheless, the present invention could be incorporated into a table having a single top or more than two tops.

Top 5 is swingably connected to the base by two pairs of parallel links 6c and 6e, respectively, one pair 6c being positioned at the central portion of the base and the other pair 6e being positioned at a base end. One end of each link is pivotally secured to a base cross rail 3. The other end of each link is pivotally connected to the top. The manner of attachment of the links to the top is different for the different links.

The upper ends of two corresponding links at opposite ends of the top are located adjacent to one tabletop edge. The upper end of the central link of such corresponding links is pivotally connected to a block 7 carrying the central end of the top. The upper end of the end link of such corresponding links is connected to a generally triangular end support plate 8 carrying the end of the top at the table end. The upper ends of the other two corresponding links are connected rigidly at approximately the transverse center of the tabletop to a longitudinal tie rod 9 which has its ends pivotally supported by block 7 and support plate 8, respectively. Central and end cross rails 3 have upwardly opening notches 10 for receiving the tie rod when the tabletop is in lowered position.

Figure 5:
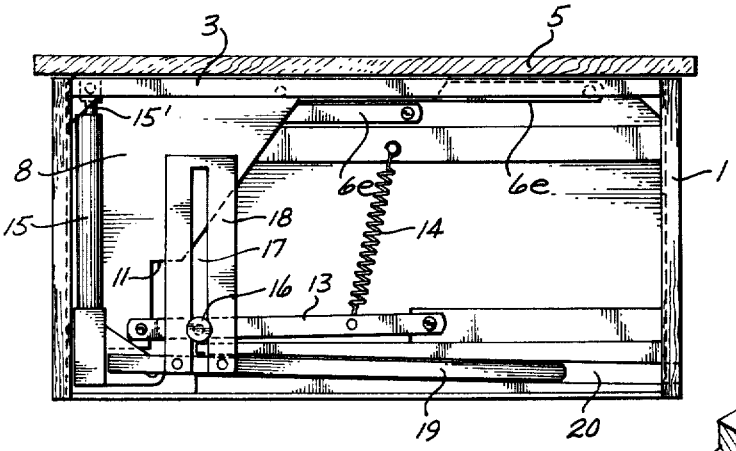
FIG. 5 is an end elevation of the table of FIG. 1 with the table end panel removed.

As best seen in FIG. 5, end links 6e are offset vertically relative to one another so that such links are in relationship one overlying the other when top 5 is lowered. As best seen in FIG. 2, center links 6c are offset laterally relative to each other so as to be disposed in side-by-side relationship when the tabletop is in its lowered position. Such links have their upper ends connected, respectively, to opposite sides of block 7 and their lower ends connected, respectively, to the opposite cross rails 3 forming the central slot between them, so that the adjacent sides of such links do not engage each other as the top is lowered. In lowered position of the tabletop the links 6c lie alongside each other in such central slot.

Figure 4:
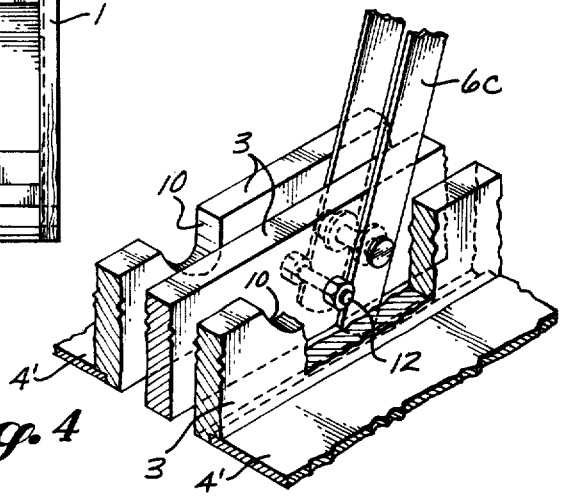
FIG. 4 is an enlarged top perspective of a fragment of the table of FIG. 1 with parts broken away.
Figure 6:
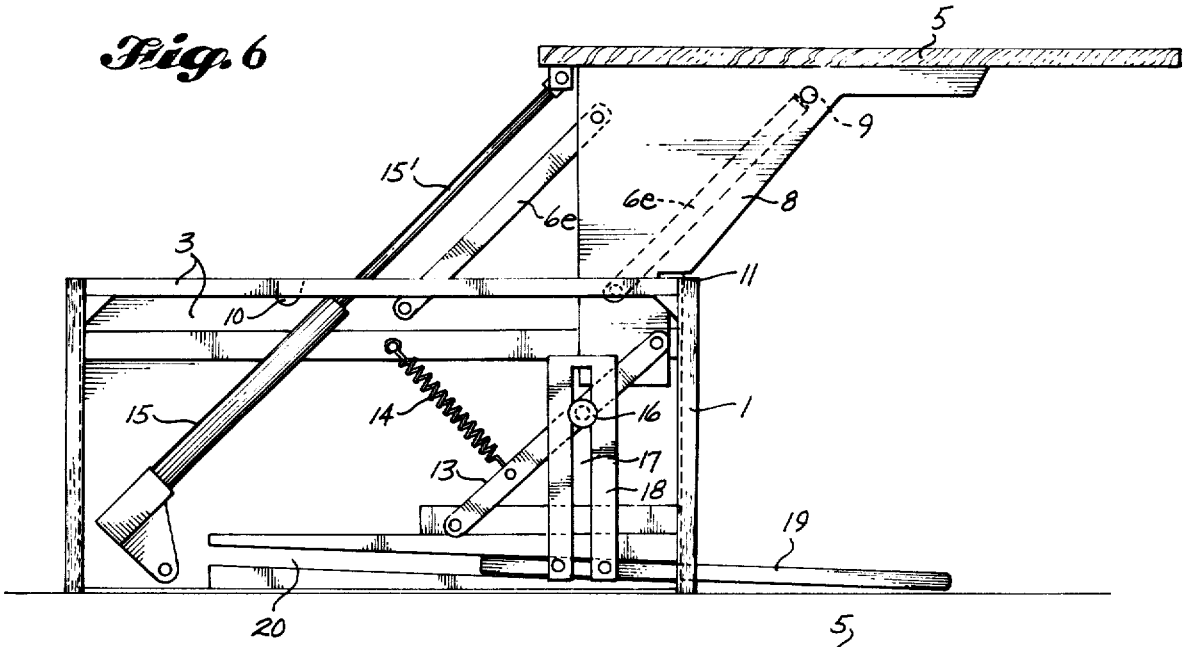
FIGS. 6 and 7 are end elevations corresponding to FIG. 5 with parts in different positions.
Figure 7:
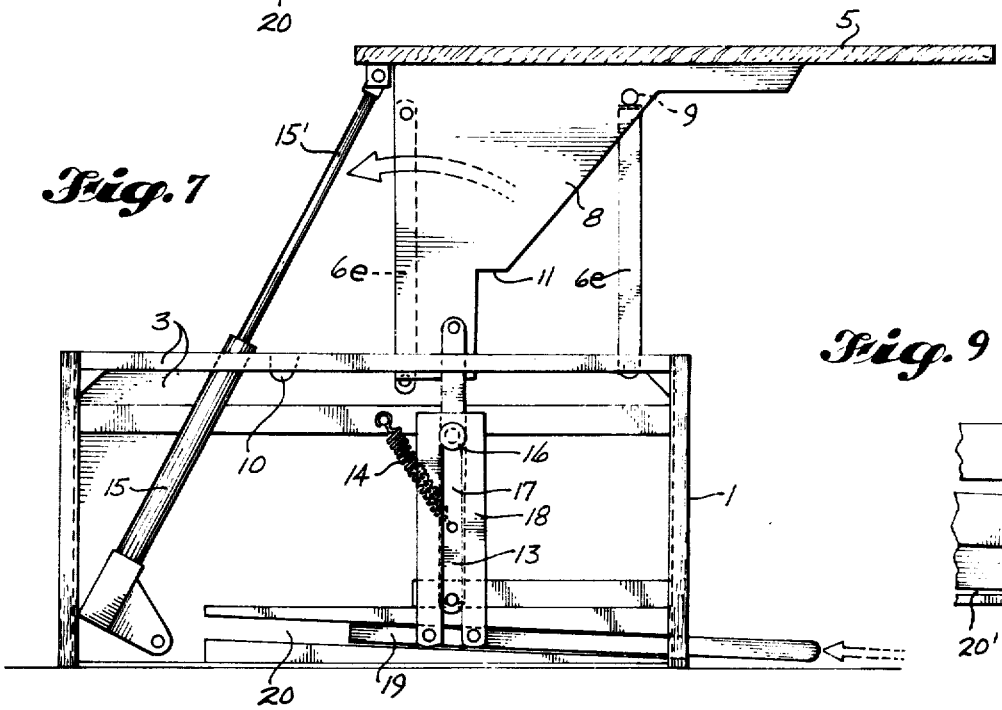

The distance between the points of connection to the top and base is the same for each of the parallel links so that the top will remain in level attitude as it is swung from lowered position shown in FIG. 5, past equilibrium position shown in FIG. 7, to raised position shown in FIG. 6. A shoulder 11 of the triangular end support plate 8 acts as a stop by engaging a table leg when the top is in raised position. As best seen in FIG. 4, additional stop mechanism is provided at the center of the table base by an end portion of a link 6c extending beyond its point of attachment to the base engaging a stop pin 12 carried by a rail 3.

Another link 13, of the same length as links 6c and 6e and always parallel to them but located below the end pair of links 6e, has its ends pivotally connected to the lower portion of table leg 1 and to the lower portion of support plate 8, respectively. The three point connection of tabletop 5 and of the table base to the three links provides for smoother swinging of the top than if only two links were provided at generally the same elevation. In addition, tie rod 9 maintains corresponding links 6c and 6e at opposite ends of the top in alignment, synchronizing movement of such links to prevent swinging of one link relative to the opposite link. Further, sidesway and twisting of top 5 relative to the table base are deterred a pair of cross rails 3 positioned closely adjacent to and at opposite sides of end support plate 8 to guide its swinging. Consequently, the top may be swung smoothly up or down without jamming or twisting.

As best seen in FIGS. 5, 6 and 7, a counter-balancing tension spring 14 is connected between the table leg and lower link 13 to reduce the force required to swing the top from lowered position or raised position to its equilibrium position shown in FIG. 7. Spring 14 is positioned so that it is stretched approximately the same amount, and applies approximately the same counterbalancing force, when top 5 is lowered from equilibrium position as when it is raised from such position. A pneumatic check including a cylinder 15 in which a plunger 15' reciprocates has the lower end of its cylinder pivotally connected to the table leg and the upper end of its plunger connected to the tabletop so that a top may be swung from raised position past equilibrium position toward lowered position and released, to be counterbalanced by spring 14 and cushioned by the check in its descent to lowered position. The pivot point of the check cylinder is offset from the cylinder so that it swings upward toward the tabletop as the tabletop is raised.

With top 5 in raised position, at least a portion of the laterally offset top overhangs beyond the base. Downward force exerted on such overhanging portion tends to tip the table. In the embodiment shown in FIGS. 1 through 7, stabilizing mechanism is provided to be projected outward from the base to deter tipping of the table by such force. As best seen in FIGS. 5, 6 and 7, lower link 13 carries a thrust roller 16 between its respective points of connection to the table base and table end support plate 8. Such thrust roller is received in the vertical slot 17 of an upright 18 projecting upward from and carried by a horizontal stabilizing foot bar 19. The foot bar is guided for lengthwise sliding by a slot 20 in the table leg.

As the tabletop is swung relative to the base, the horizontal component of the swinging motion of link 13 causes thrust roller 16 to exert a horizontal force on foot bar 19 lengthwise of such bar for sliding the bar along slot 20. Thus, as the top is raised foot bar 19 is projected outward automatically from the table base beneath the overhanging portion of the laterally offset tabletop. Conversely, as the top is swung to lowered position, the foot bar is retracted lengthwise into the base.

For best support, when the tabletop is in raised position it is desirable for at least the outer end portion of foot bar 19 to bear firmly on the surface supporting the table. However, to prevent marring or excessive wearing of the supporting surface, it is desirable that the foot bar not be dragged on the supporting surface as it is projected or retracted. In the embodiment shown in FIGS. 5, 6 and 7, the foot-receiving slot 20 is inclined downward toward the side of the table leg from which the foot bar projects to guide the foot downward into engagement with the floor at the end of its travel. As shown in FIG. 6, when the tabletop is in raised position the lowermost portion of foot bar 19 is held firmly on the supporting surface and is generally aligned with the lowermost portion of the table base. When the tabletop is swung upward from raised position to its equilibrium position shown in FIG. 7, the outer end of the foot bar is lifted from the supporting surface and retracted toward the table base without dragging on the supporting surface.

Figure 9:
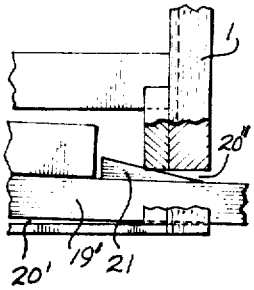
FIG. 9 is an enlarged end elevation of a fragment of the table of FIG. 8 with parts broken away.
Figure 8:
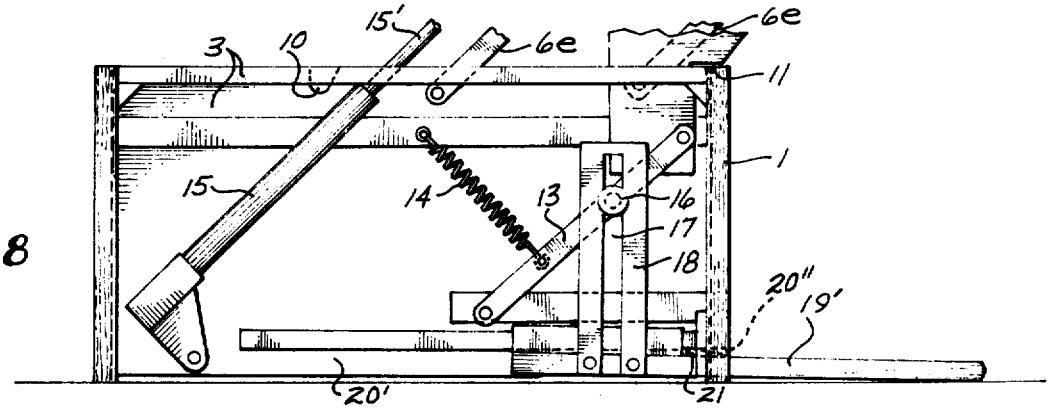
FIG. 8 is an end elevation of an alternative embodiment of a convertible table in accordance with the present invention having parts broken away.

In the alternative embodiment shown in FIGS. 8 and 9, foot bar 19' is slidable along a horizontal slot 20≧ and through an aperture 20'' in the lower portion of the table-supporting leg 1. The foot bar fits somewhat loosely in the slot. The upper surface of foot bar 19' carries a wedge 21 tapered in the direction of foot projection and positioned so that the wedge contacts the upper side of aperture 20" as the foot bar approaches maximum projection. Consequently, as the tabletop 5 is raised, foot bar 19' is projected generally linearly horizontally from the table base until the table top 5 approaches raised position, whereupon the wedge engages the upper side of aperture 20". As the tabletop continues its motion to raised position, the horizontal force of thrust roller 16 on upright 18 tilts the upright because foot bar 19' cannot be projected farther outward after engagement of its wedge with the upper side of aperture 20". Such tilting swings the foot bar generally about wedge 20, lifting the foot bar inner end and forcing the foot bar outer end downward into firm engagement with the supporting surface. When the tabletop is swung from raised position to lowered position, wedge 21 is released from engagement with the edge of aperture 20" and the foot bar outer end is raised as it is retracted without wearing or marring the supporting surface.

Figure 10:
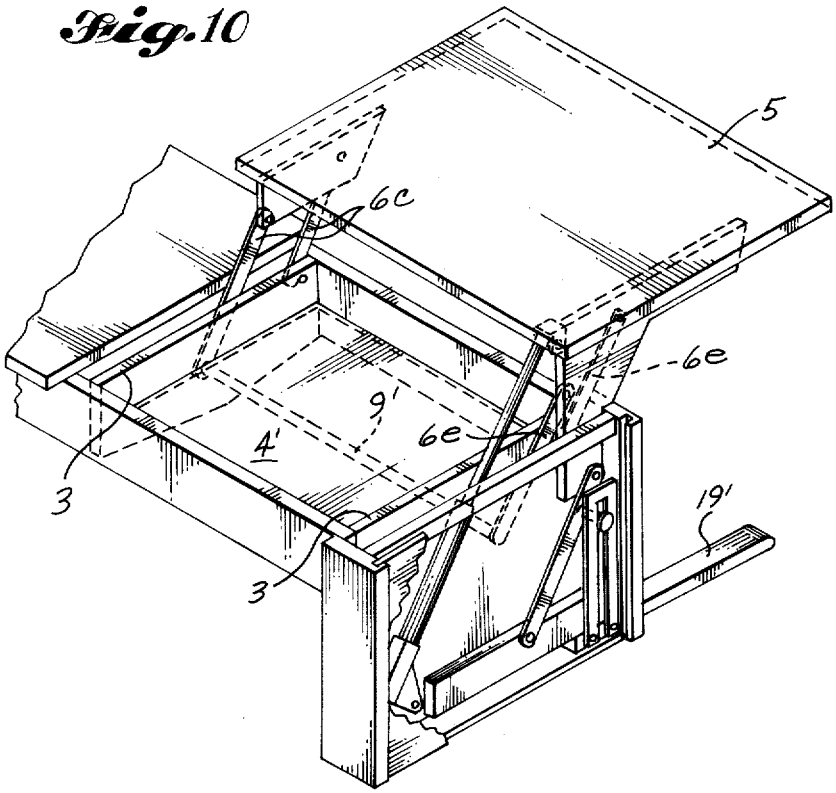
FIG. 10 is a fragmentary top perspective of another alternative embodiment of a convertible table in accordance with the present invention.
Figure 11:
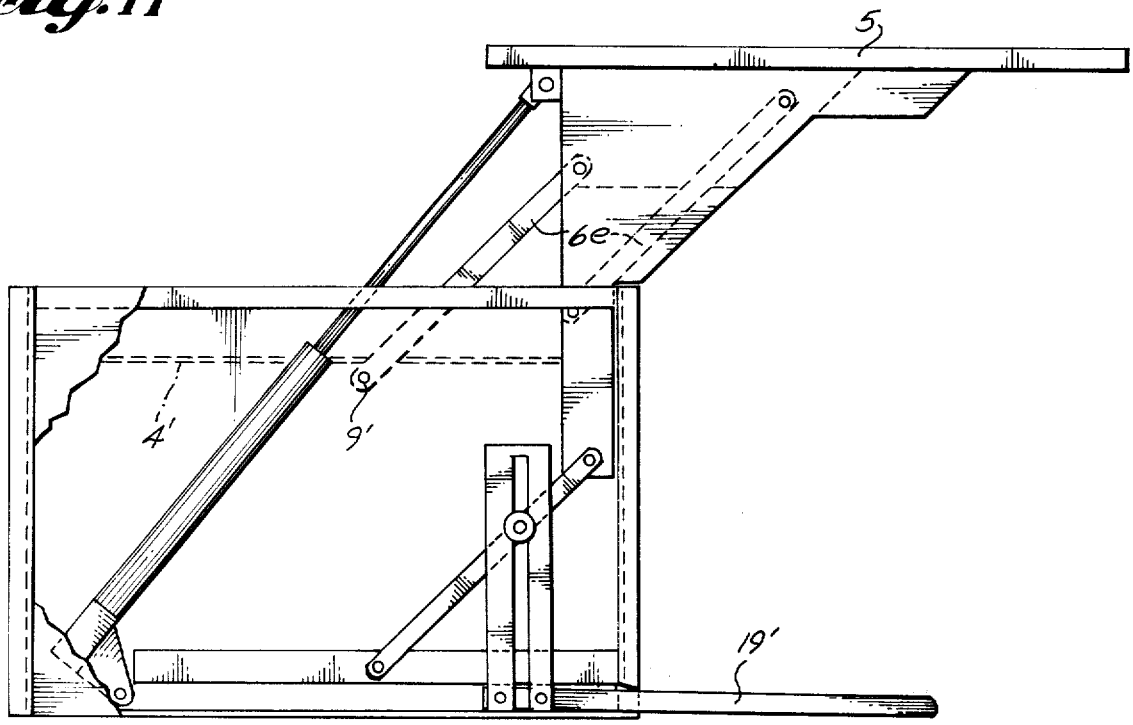
FIG. 11 is an end elevation of the table of FIG. 10.
Figure 13:
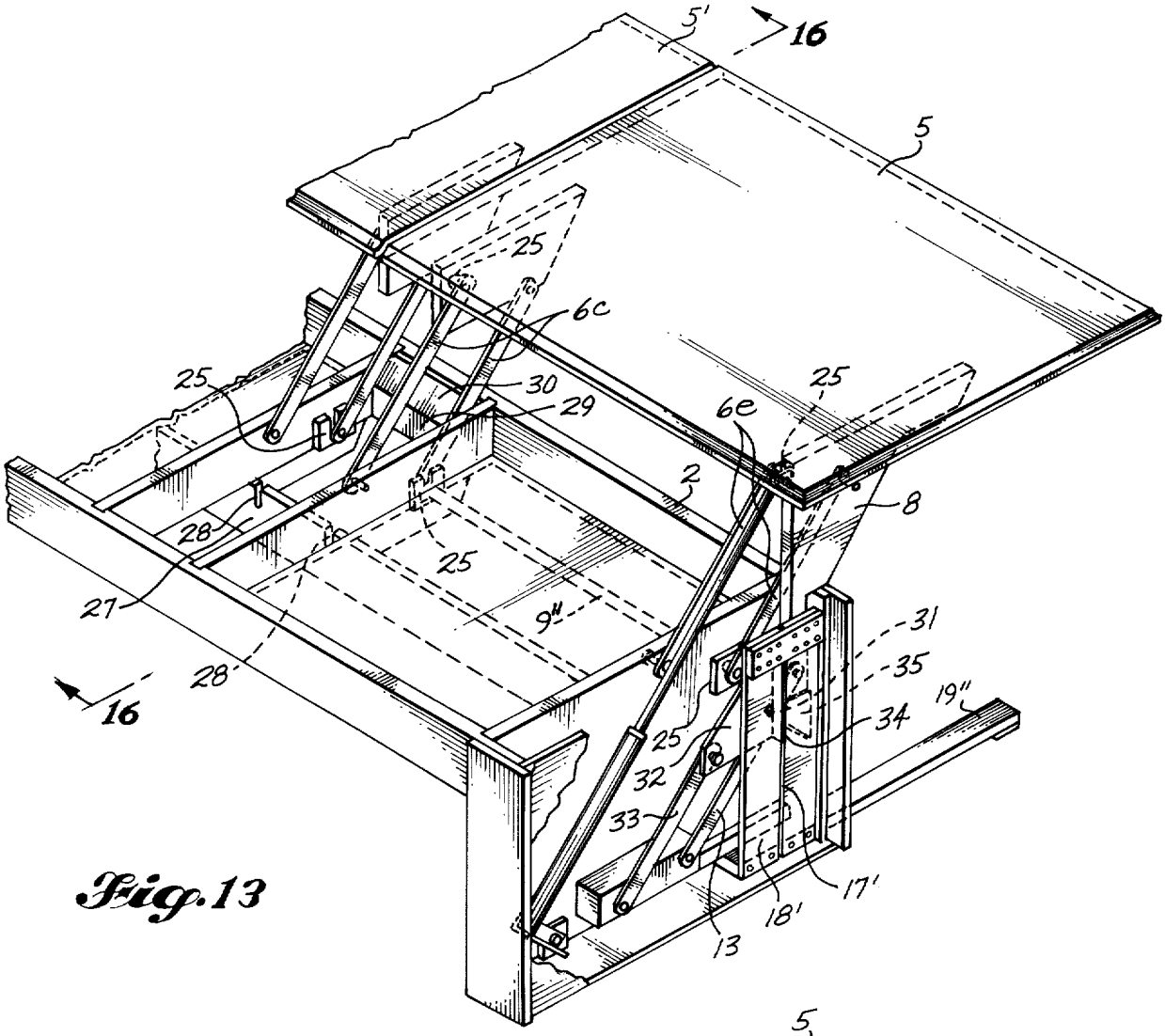
FIG. 13 is a fragmentary top perspective of yet another alternative embodiment of a convertible table in accordance with the present invention.
Figure 14:
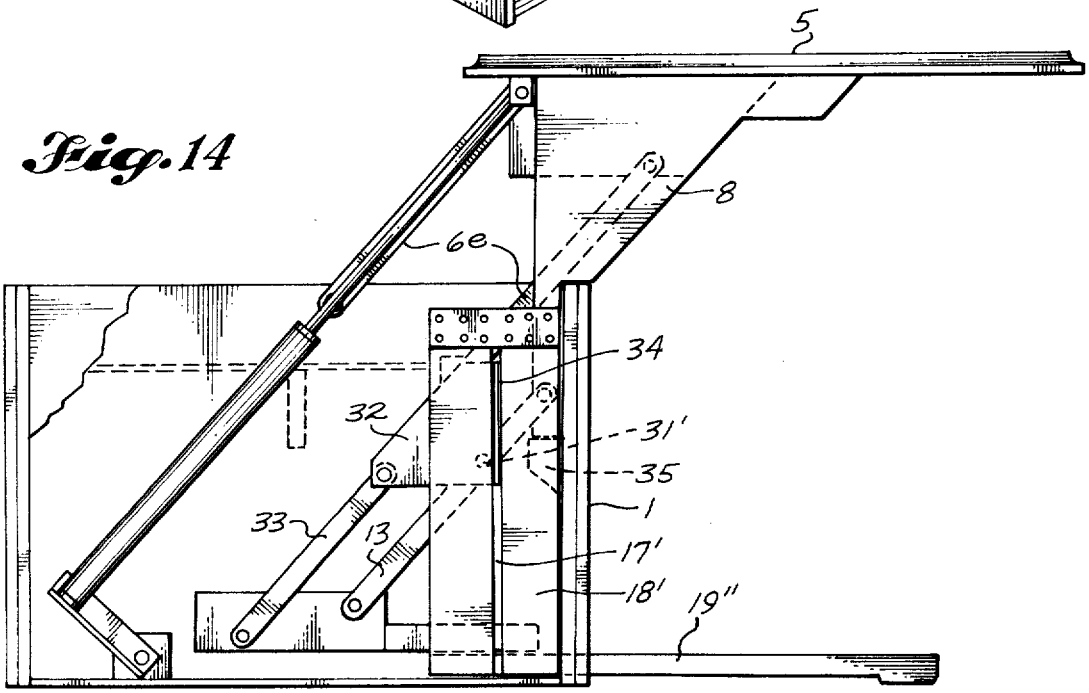
FIG. 14 is an end elevation of the table of FIG. 13.
Figure 15:
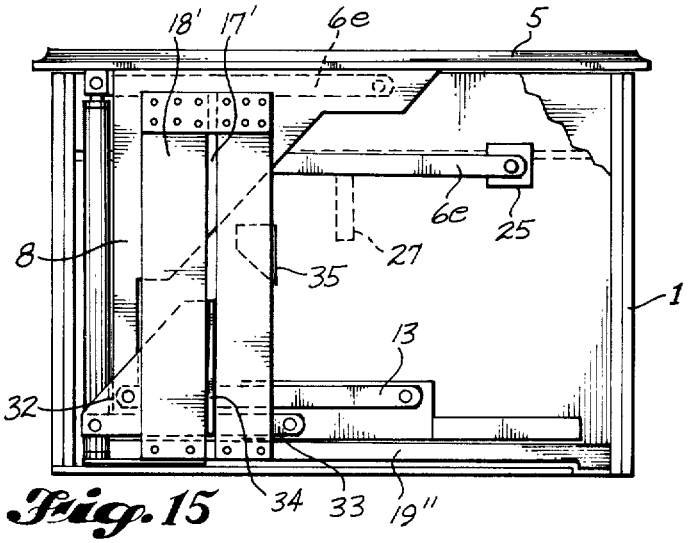
FIG. 15 is a corresponding end elevation with parts in different positions.

The alternative embodiment shown in FIGS. 10, 11 and 12 is similar to the embodiment shown in FIGS. 8 and 9 except that the position of tie rod 9' and the relative positions of the links in the pairs of links 6c and 6e have been changed. The amount links 6e are offset elevationally from each other is increased and links 6c are offset elevationally from each other the same amount. Rather than interconnecting the upper ends of the links adjacent to a longitudinal edge of the table by a tie rod 9 as in the table of FIGS. 1 to 9, tie rod 9' interconnects the lower ends of links which have their lower ends located approximately at the transverse center of the table base. The elevation of the lower pivots for such links is such that tie rod 9' is below panel 4' forming the bottom of the storage space underneath tabletop 5. Consequently, cross rails 3 do not need notches in their upper edges to receive the tie rod when the top is in lowered position and the tie rod does not impair the usefulness of the storage space. Further, since links 6c are offset vertically relative to each other, they can be aligned laterally and still will not interfere with each other when the tabletop is lowered.

The mechanism for operating the foot bar 19' of the table shown in FIGS. 10 and 11 is the same as that described in connection with FIGS. 8 and 9.

In the second alternative embodiment shown in FIGS. 13 through 17, as in the embodiment of FIGS. 10 through 12, the pivots of the links of each pair of links 6e and 6c are offset elevationally relative to each other. However, the link of each pair having an end pivotally connected to the transverse central portion of the table base is higher than the other link of such pair, rather than lower than such other link as in the table shown in FIGS. 10 through 12. Consequently, when the tabletop 5 is being raised the lower link swings across the lower pivot axis of the upper link so that it is necessary to offset the links of each pair laterally relative to each other to prevent them from coming into engagement when tabletop 5 is raised or lowered. Such offsetting is accomplished by providing spacer blocks 25 for the lower ends of the lower links and for the upper ends of the upper links. The lower spacer blocks are located between the respective link ends and the cross rail 3 to which they are pivoted. The upper spacer blocks are located between the respective upper link ends and the tabletop supports.

A tie rod 9" extends beneath the storage space panel 4', interconnects the lower ends of the lower links and forms the pivot for such links. A longitudinal beam 27 supports the transverse center of panel 4' from below. Such beam has notches 28 for receiving the lower center links 6c when the tabletops are in lowered position.

Figure 16:
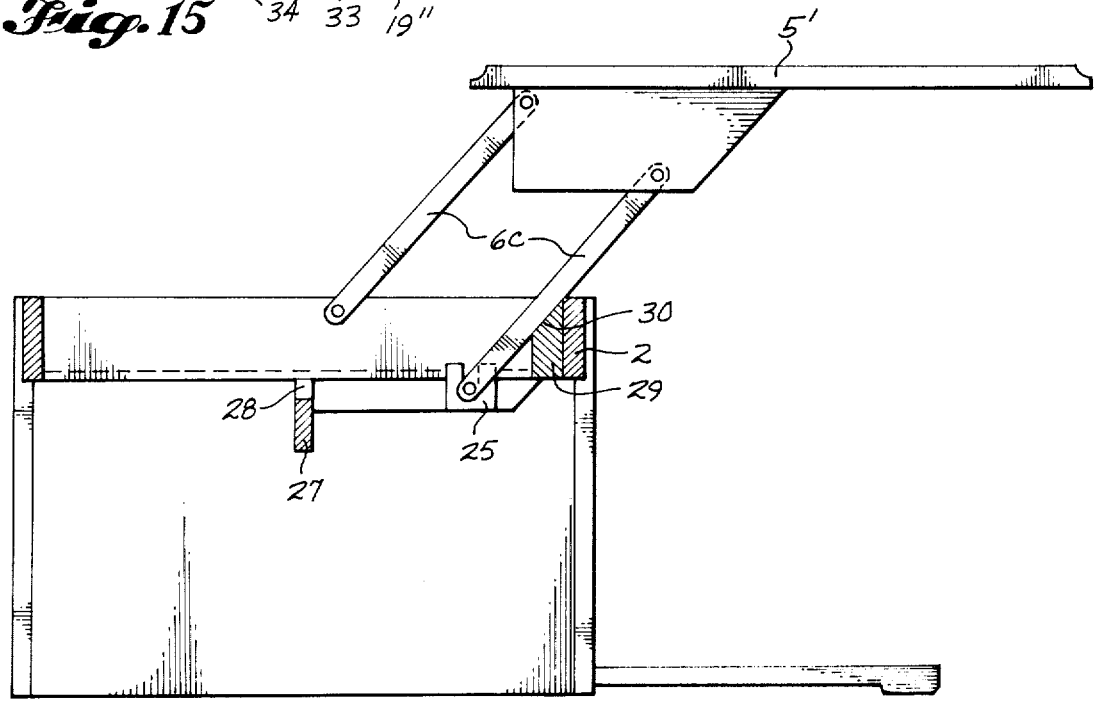
FIG. 16 is a section taken on the line 16—16 of FIG. 13.
Figure 17:
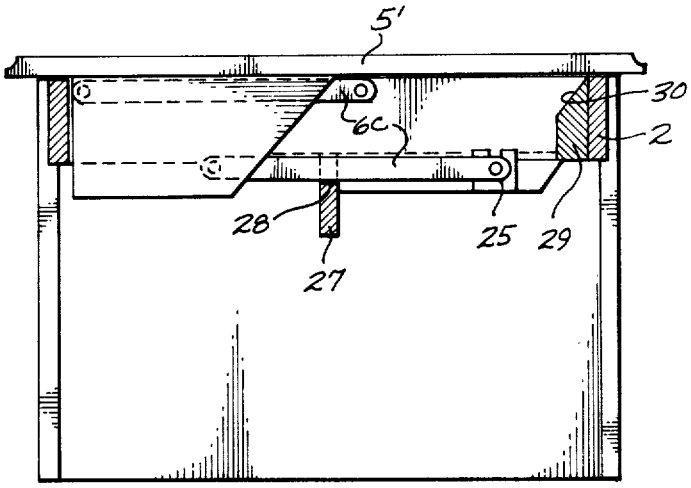
FIG. 17 is a corresponding section with parts in different positions.

Another modification of the embodiment of FIGS. 13 through 17 is the stop mechanism for the lower links 6c, best seen in FIGS. 16 and 17. A stop block 29 is secured to the inner vertical face of the longitudinal rail 2 extending along the side of the table over which tabletop 5 overhangs when it is raised. Such block includes an inner beveled portion 30 that is engaged contiguously by the outer edge of each lower center link 6c when the tabletop is in raised position as shown in FIG. 16. Such beveled portion provides a sturdier stop than pin 12 shown in FIG. 4 and is more effective because it is located farther from the link pivots.

A further modification of the embodiment of FIGS. 13 through 17 is the mechanism for automatically projecting a stabilizing foot bar 19" as the top is raised. As in the previous embodiments, a lower link 13, of the same length as links 6c and 6e and always parallel to them, has its ends pivotally connected to table leg 1 and to support plate 8, respectively. A portion of such lower link between its ends is pivotally connected by a pivot 31 to the lower portion of a generally triangular thrust plate 32 having its base horizontal and an upright edge perpendicular to its base. Another parallel link 33 connects the lower corner portion of thrust plate 32 remote from its upright side to the table end. The distance between the pivot connections of link 33 to the table end and to the thrust plate is the same as the distance between the pivot connection of link 13 to the table end and pivot 31 connecting such link to the thrust plate.

A thrust flange 34 extends perpendicularly outward from the upright edge of thrust plate 31. Since the thrust plate is connected to the table end by parallel links of equal length, namely by links 13 and 33, the thrust flange remains substantially vertical as the thrust plate is shifted transversely of the table by elevational movement of the tabletop.

Flange 34 is received in a narrow vertical slot 17' in an upright 18' the lower end of which carries the stabilizing foot bar 19". As tabletop 5 is swung from lowered position, shown in FIG. 15, to raised position, shown in FIG. 14, the swinging of link 13 is converted into substantially horizontal projection of foot bar 19" by the vertical thrust flange 34 bearing on an edge of the upright slot 17'. Similarly, as the top is lowered foot bar 19" is retracted automatically.

To assure that the outer end of foot bar 19" bears firmly on the surface supporting the table when the tabletop is raised, upright 18' carries a pivot block 35 and a portion of such block projects beyond the edge of upright 18' from which the foot bar extends. As the tabletop nears raised position, block 35 engages a side of the table end. As the table top is swung still further toward raised position, thrust flange 34 bearing on an edge of the vertical upright slot 17' forces upright 18' to swing generally about pivot block 35 forcing the outer end of foot bar 19" into firm engagement with the supporting surface.

In the third alternative embodiment shown in FIGS. 18, 19 and 20, the relative positions of the links supporting tabletop 5 are the same as for the embodiment of FIGS. 13 through 17. The mechanism for automatically projecting and retracting a stabilizing foot bar 19''' is quite similar to the foot-projecting mechanism of the embodiments of FIGS. 8 and 9 and FIGS. 10, 11 and 12 in that a lower link 13 pivotally connects a generally triangular table end support plate 8 and a table leg 1. A thrust roller or pin 16 is carried by the lower link between its ends and is received in the vertical slot 17 of an upright 18 projecting upward from and carried by foot bar 19'''. The upright is housed in the hollow table leg and the foot bar is guided for lengthwise sliding out of the hollow leg by a horizontal slot 20 in such leg.

In contrast to previous embodiments, in the embodiment of FIGS. 18, 19 and 20 horizontally elongated guide blocks 38 project outward from the side of upright 18 and are received in a generally horizontal groove 39 in the inner side of the table end outer panel 4. The guide blocks and horizontal groove cooperate to maintain the upright vertical as it is shifted transversely of the table by the tabletop being moved between its lowered position shown in FIG. 18 and its raised position shown in FIG. 19.

The upper side of groove 39 is angled downward toward its end nearer the side of the table that tabletop 5 overhangs when in raised position. Consequently, as the tabletop is raised foot bar 19 initially is projected generally horizontally from the table leg by travel of the upright 18 toward such table side, and as the tabletop nears raised position the foot bar is forced downward into firm engagement with the surface supporting the table by the upright being wedged downward by engagement of the guide blocks with such angled portion of the panel groove. The lower edge of the guide groove 39 is angled upward toward the transverse center of the table at a location somewhat farther from the table side which the tabletop overhangs than the spacing of the angled upper groove side from such table side. Engagement of the guide blocks with such angled portion of the lower edge of the guide groove wedges the upright 18 upward to lift the foot bar 19 away from the surface supporting the table as the upright is shifted transversely of the table by lowering the tabletop.

While the present invention has been described in conjunction with a coffee table, it is intended that it may be used in conjunction with any other type of table in which a top is shiftable to a position laterally offset from a supporting base. In each such table, stabilizing mechanism projecting outward from the base automatically to engage a supporting surface in response to shifting of the top will deter upsetting of the table.

I claim:

1. A convertible table comprising a table base for engaging a supporting surface, a tabletop normally supported in horizontal position overlying said table base, means connecting said top and said base enabling shifting of said top between its normal position principally over said base and a position in which said top is displaced laterally at least partially offset from said base, a stabilizer projectable outward from said base to deter tipping of the table, and actuating means for projecting said stabilizer automatically by shifting of said top to offset position.

2. A convertible table comprising a table base for engaging a supporting surface, a table top, connecting means including links at opposite ends of said top pivotally connecting said top and said base and enabling elevational and lateral movement of said top relative to said base between a normal lowered position and a raised laterally offset position, a stabilizer projectable outward from said base to deter tipping of the table, and actuating means for projecting said stabilizer automatically by shifting of said top to offset position.

3. The table defined in claim 1 or 2, the connecting means enabling shifting of the tabletop between its normal and offset positions with the tabletop remaining substantially horizontal.

4. A convertible table including a table base for engaging a supporting surface, a tabletop, means connecting said top and said base enabling shifting of said top between a normal position and a position at least partially offset laterally from said base, a stabilizer projectable outward from said base to deter tipping of the table and having wedge means positioned to engage said table base when said stabilizer is projected for effecting downward swinging of the outer end of said stabilizer, and actuating means for projecting said stabilizer automatically by shifting of said top to offset position for engaging said wedge means with said table base for holding said stabilizer in firm engagement with the supporting surface when said top is in laterally offset position.

5. A convertible table comprising a table base for engaging a supporting surface, a tabletop, parallel links swingably connecting opposite ends of said top to said base enabling shifting of said top between a normal position and a position at least partially offset laterally from said base, a stabilizer projectable outward from said base to deter tipping of the table, and actuating means for projecting said stabilizer automatically by shifting of said top to offset position, said actuating means including an upright carried by said stabilizer and thrust means carried by one of said links and cooperating with said upright to convert the swinging motion of the thrust means-carrying link into generally linear projection of said stabilizer when said top is shifted toward laterally offset position.

6. The table defined in claim 1 or 2, the actuating means including means for retracting the stabilizer toward the base automatically when the top is shifted from offset position toward normal position.

7. The table defined in claim 6, the actuating means including guide means to avoid pressure of the stabilizer on the supporting surface as the stabilizer is projected or retracted.

8. The table defined in claim 7, the guide means including a slot in the table base receiving the stabilizer.

9. The table defined in claim 8, the slot being inclined downward in the direction of stabilizer projection.

10. The table defined in claim 1, 2, 3 or 4, the stabilizer being a foot bar having an outer end and the actuating means for projecting said foot bar moving said foot bar outer end generally linearly lengthwise of said foot bar.

11. The table defined in claim 1, 2, 3 or 4, the actuating means including means for holding the stabilizer in firm engagement with the supporting surface when the top is in laterally offset position.

12. The table defined in claim 4, the thrust means being carried by one of at least three links at one end of the tabletop.

13. The table defined in claim 4 or 6, guide means for maintaining the upright generally vertical as the top is shifted.

14. The table defined in claim 13, the guide means including a guide block carried by and projecting outward from the upright and a member adjacent to the upright which member has a generally horizontal groove receiving the guide block.

15. The table defined in claim 14, the groove in the member adjacent to the upright including a portion angled downward in the direction the stabilizer is projected from the table and engageable by the guide block for wedging the upright and the stabilizer downward as movement of the tabletop to offset position shifts the upright transversely of the table.

* * * * *